United States Patent [19]

Robson

[11] 3,943,638

[45] Mar. 16, 1976

[54] CONDENSATE REMOVAL DEVICE

[76] Inventor: James A. W. Robson, 118 Viking Ave., Point-Claire, Quebec, Canada

[22] Filed: Nov. 19, 1974

[21] Appl. No.: 525,097

Related U.S. Application Data

[63] Continuation of Ser. No. 221,337, Jan. 27, 1972, abandoned.

[30] Foreign Application Priority Data

Jan. 27, 1971 Canada ..... 103838

[52] U.S. Cl. ..... 34/124; 34/125; 34/119

[51] Int. Cl.[2] ..... F26B 11/02

[58] Field of Search ..... 34/54, 73, 133, 119, 124, 34/125, 14, 41, 122; 165/90

[56] References Cited

UNITED STATES PATENTS

| | | | |
|---|---|---|---|
| 683,237 | 9/1901 | Whittle | 34/124 |
| 1,709,581 | 4/1929 | Johnson | 34/119 |
| 2,677,898 | 5/1954 | Ohlson et al. | 34/119 |
| 3,009,261 | 11/1961 | Hieronymus | 34/125 |
| 3,034,225 | 5/1962 | Hieronymus | 34/125 |

*Primary Examiner*—John J. Camby
*Assistant Examiner*—Henry. c. Yuen
*Attorney, Agent, or Firm*—Alan Swabey & Co.

[57] ABSTRACT

A device for use in removing condensate from rotatable, steam dryer drums. The device includes a pick-up head and a curved tube connected to the head at one end with the opposite end extending at right angles to the one end for connection to an outlet conduit leading out of the dryer drum. The pick-up head is located adjacent the inner surface of the drum and is maintained in this position by support means connected to the tube. The support means has a support member bearing against the wall of the drum in diametrically opposed relation to the pick-up head. The support means can be adjusted and locked in different positions to maintain the pick-up head in its proper position.

6 Claims, 3 Drawing Figures

CONDENSATE REMOVAL DEVICE

This is a continuation of Ser. No. 221,337, filed Jan. 27, 1972, now abandoned.

BACKGROUND OF THE INVENTION

1. Field of the Invention

This invention relates to an improved device for use in removing condensate from a rotatable, steam dryer drum.

2. Description of the Prior Art

Rotatable, steam dryer drums are used in paper mills to dry sheet or web material. Steam is introduced into the rotatable drums to provide the heat to dry the material. Means have been provided in the drums for removing the condensate therefrom, formed when the steam condenses within the drums. These means comprise one or more condensate pick-up heads which are mounted to lie adjacent the inner cylindrical wall of the drum and which are connected, through an outlet conduit, with a siphon device located outside the drum. The pick-up head rotates with the drum and picks up the condensate travelling on the wall of the rotating wall. This condensate is then drawn out of the drum by the siphon device through the outlet conduit connected to the pick-up head.

One such device for removing condensate is shown in Canadian Pat. No. 647,583, issued Aug. 28, 1962, John W. Hieronymus, inventor. The device shown in this patent employs a particular type of condensate pick-up head attached, by means of an elbow fitting, to an outlet conduit leading out of the drum. Spring-loaded bracing means are provided for biasing the pick-up head against the wall of the drum to maintain the head in the proper position.

In practice, it has been found that the known condensate removal devices, such as those shown in the patent, for example, have numerous disadvantages. The devices are relatively expensive due to the use of a special elbow-type fitting to both connect the conduit leading from the pick-up head to the outlet conduit, and also to provide attachment of a bracing member. In addition, elbow fittings are somewhat inefficient removing condensate due to the sharp constricted turn in the fitting. The expense of the devices is further increased by the use of a relatively compliated condensate pick-up head. Known devices employing a spring mounting in order to bias or brace the pick-up head against the wall of the drum have also been found disadvantageous since a spring mounting results in a tendency of the pick-up head to vibrate, particularly during high speed operation of the dryer drum. The vibrations are detrimental to the proper operation of the device.

SUMMARY OF THE INVENTION

It is the purpose of the present invention to provide an improved condensate removal device which overcomes the disadvantages of the prior art. It is more particularly the purpose of the present invention to provide a device for use in removing condensate from a rotatable steam dryer drum which is relatively inexpensive to manufacture and install, which is more efficient in operation, and which is more readily maintained in proper operating position during drum rotation at all times.

Applicant has found that an improved condensate pick-up head can be constructed employing a curved conduit to connect the pick-up head to the outlet conduit. The curved conduit improves the efficiency of the siphon device in withdrawing condensate from within the drum. A special pick-up head, therefore, is not required. The curved conduit also eliminates the use of a specific fitting to connect the duct leading from the pick-up head to the outlet conduit. The use of the curved conduit to connect the pick-up head to the outlet conduit results in improved efficiency and also reduced cost in the manufacture and construction of the pick-up device.

The invention is more particularly directed toward a device for use in removing condensate from a rotatable steam dryer drum which comprises a condensate pick-up head and a substantially rigid tube for carrying condensate. One end of the tube is connected to the pick-up head. The opposite end of the tube has means for connecting it to a conduit leading from the drum. The tube is curved to have its opposite end extend in a direction substantially transverse to the direction in which the one end extends. Support means are connected to the tube terminating in a free end which extends in a direction substantially transverse to the direction in which the opposite end of the tube extends. Threadably adjustable means are mounted on the support means at its free end. Means are also provided for locking the threadably adjustable means.

BRIEF DESCRIPTION OF THE DRAWINGS

The invention will now be described in detail having reference to the accompanying drawings, wherein.

DESCRIPTION OF THE PREFERRED EMBODIMENT

Figure 1:
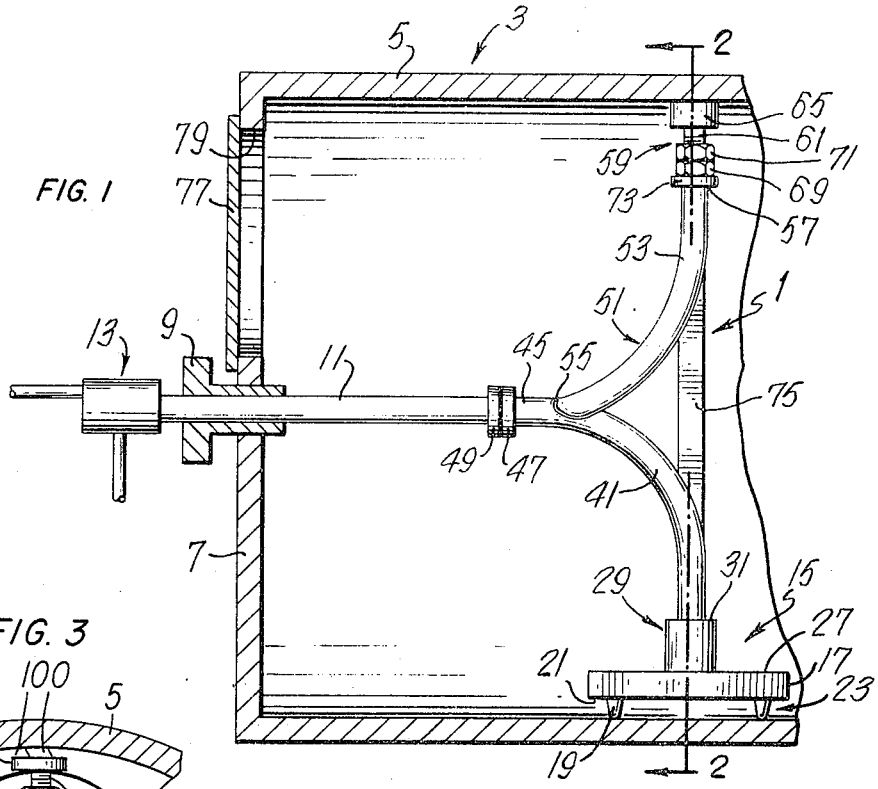
FIG. 1 is a cross-sectional view showing the condensate removal device mounted in a steam dryer drum.

The device 1 for use in removing condensate is adapted to be mounted in a rotatable steam dryer drum 3 having a cylindrical wall 5 and end walls 7, only one of which is shown. In the one end wall 7, a journal 9 is provided through which an outlet conduit 11 passes extending axially of the drum. One end of the conduit 11 is rotatably connected to a siphon device 13 located outside the drum. The siphon device 13 draws condensate from within the drum out through the conduit 11.

The condensate removal device 1 includes a condensate pick-up head 15. The pick-up head 15 comprises a substantially rectangular plate member 17 with legs 19 fixed to one surface 21 of the plate member and extending therefrom to support the pick-up head on the cylindrical wall 5 of the drum with the one surface 21 spaced from the wall of the drum. This manner of mounting provides a gap 23 about the periphery of the plate member 17 of varying dimension through which condensate can be drawn. The pick-up head 15 is positioned on the wall of the dryer drum with the long dimension of the plate extending in a direction parallel to the axis of the drum.

The plate member 17 has a central aperture 25, and mounted on the opposite surface 27 of the plate member is a collar member 29 concentric with the aperture 25. The collar member can be counter-bored from one end 31 to provide a locating shoulder 33 within its central bore 35. The central aperture 25 in the plate member can be radiused as shown at 37 together with the other end 39 of the collar member 29 to provide a smooth entrance for the condensate to be picked up by the head.

A rigid tube 41 is provided for connecting the pick-up head 15 to the outlet conduit 11. One end 43 of the tube 41 is inserted into the one end 31 of the collar 29 to rest on the shoulder 33 and is welded to the collar. The other end 45 of the tube has a flange 47 for permitting its connection to a flange 49 on the end of the outlet conduit 11 within the drum. The tube 41 is curved so as to have its other end 45 extend in a direction substantially transverse to the direction the one end 43 of the tube extends in. Preferably, the tube 41 is curved along a radius. The radius along which the tube is curved will vary depending upon the diameter of the drum and the diameter of the tube. However, the radius of curvature of a tube, 1 inch in diameter, should not be less than 10 inches so as to avoid constrictions, or sudden changes in direction, in the tube.

Support means 51 are provided for rigidly bracing the pick-up head 15 against the wall 5 of the drum. The support means can comprise a curved tubular section 53, one end 55 of which is connected to the wall of tube 41 adjacent the flange 47, preferably by welding. The section 53 terminates in a free end 57 extending in a direction substantially transverse to the direction the other end 45 of the tube extends in, and preferably extending in a diametrically opposed direction to the direction the one end 43 of the tube, connected to the pick-up head, extends in. A support member 59 is mounted on the tubular section 53 at its free end 57. The support member 59 comprises a rod 61, threaded at one end 63 and having a bearing pad 65 at the other end. The threaded end 63 is sized to be inserted into the tubular section 53 at the free end 57. Two nuts 69, 71 are threaded onto the threaded end of the rod 61. The lowermost nut 69 bears against a shoulder 73 provided on the free end 57 of the tubular section. The second, uppermost nut 71 serves as a locking nut.

A bracing member 75 can be provided between the tube 41 and the tubular section 53 extending along a diametrical line between the two members and welded to the walls of the tube and tubular section.

The device 1 is installed by removing a service cover 77 in one end wall 7 of the dryer drum. The device is inserted through the service hole 79 and placed in the proper position within the drum with the pick-up head 15 adjacent the cylindrical wall 5. The flange 47 on the tube 41 is then connected to the flange 49 on the outlet conduit 11 by bolts or other suitable means. The nuts 69, 71 on the rod 61 are adjusted to permit it to be slipped into the free end 57 of the tubular section 53 and then further adjusted to abut the bearing pad 65 of the support member against the wall diametrically opposite to the pick-up head to tightly brace the pick-up head against the wall of the drum. The support member can then be locked in this position with the aid of the locking nut 71.

Figure 3:
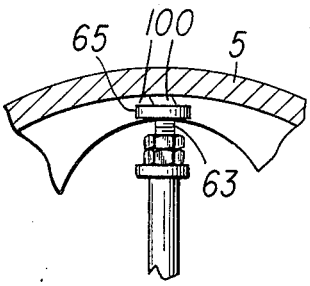
FIG. 3 is a detail view, partially in cross-section, of the bearing pad.
Figure 2:
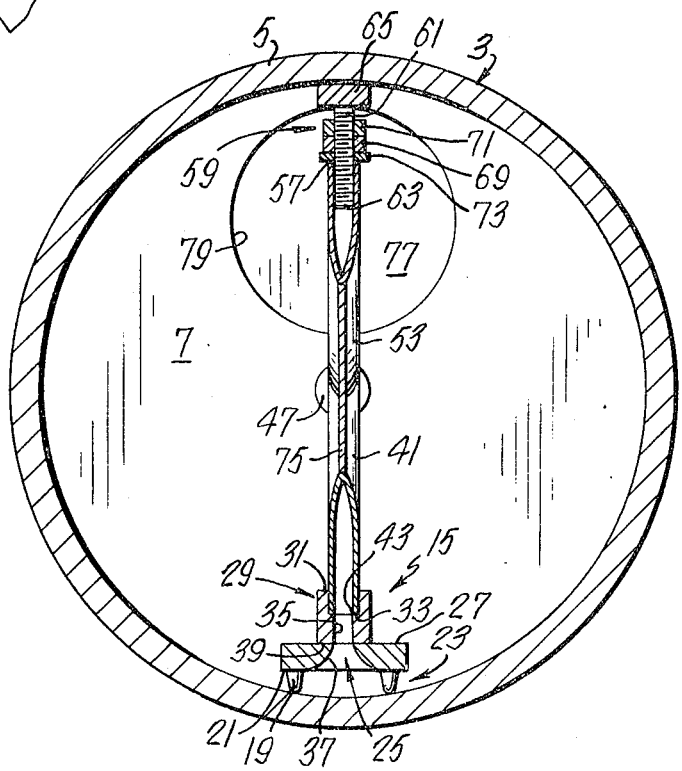
FIG. 2 is a cross-sectional view taken along line 2—2 of FIG. 1.

To accommodate possible expansion of the device 1 between pick-up head 15 and bearing pad 65 during use of the device in a high-temperature environment, the bearing pad 65 may be made in the form of a thin metal plate, attached by one surface to the end of rod 61 and having legs 100 seen in FIG. 3, similar to legs 19 on pick-up head 15, attached to the other surface of the plate for bearing against the wall of the drum. The legs are spaced from rod 61 so that the center of the plate may move toward or away from the wall of the drum relative to the portions of the plate from which the legs extend. The plate can be so designed as to flex increasing amounts to accommodate the amount of expansion encountered by the device between head 15 and pad 65 as a result of an increase in temperature.

I claim:

1. A device for use in removing condensate from the interior of a rotatable steam dryer drum comprising:
   a. a condensate pick-up head
   b. a substantially rigid unitary pick-up tube, one end of the pick-up tube connected to the pick-up head, the opposite end of the pick-up tube having means for connecting it to an outlet conduit leading from the drum, the pick-up tube being continuously curved substantially throughout its length to have its opposite end extend in a direction substantially transverse to the direction in which the one end extends,
   c. support means connected to the pick-up tube and terminating in a free end which extends in a direction substantially transverse to the direction in which the opposite end of the pick-up tube extends,
   d. threadably adjustable means mounted on the support means at its free end, and means provided for locking the threadably adjustable means,
   e. said support means including a substantially rigid unitary support tube continuously curved substantially throughout its length and being substantially symmetrical with said pick-up tube, and
   f. a bracing member connected between and being substantially axially concentric with said pick-up tube and said support tube.

2. A device as claimed in claim 1, wherein the pick-up head comprises a substantially rectangular plate having a central passageway extending therethrough, said passageway having a radiused inlet at one surface of said plate.

3. A device as claimed in claim 2, wherein legs of equal length are rigidly connected to said one surface of the rectangular plate and extend therefrom to support the plate in spaced relation to the drum and thus provide a peripheral gap of varying dimension through which the condensate can be drawn to the inlet.

4. A device as claimed in claim 1, wherein the threadably adjustable means includes a shaft having a pair of ends and being threaded at a first end, the first end being at least partially inserted into the support means at the free end the shaft carrying a pressure pad at its second end, said locking means including nuts threaded on the shaft cooperating with the free end of the support means.

5. A device as claimed in claim 4, wherein the pressure pad comprises a thin plate fixed centrally thereof, at one surface, to the shaft, and having legs extending away from the other surface, the legs offset or spaced from the shaft.

6. A device as defined in claim 1 wherein said threadably adjustable means includes a threaded shaft and partially inserted in said support tube, and a pressure pad attached to said shaft whereby relative movement of said shaft and said support tube are achieved only by movement of said threadably adjustable means.

* * * * *